US006142818A

United States Patent [19]

Hollesen et al.

[11] Patent Number: 6,142,818

[45] Date of Patent: Nov. 7, 2000

[54] IDC TWIST CAP STRAIN RELIEF

[76] Inventors: David B. Hollesen, 365 Homestead Blvd., Belle Mead, N.J. 08502; Ivan Pawlenko, 1242 Old Jordan Rd., Holland, Pa. 18966; Thelma E. Cole, 513 Whilton Rd., Neshamic Station, N.J. 08853; Jason A. Kay, 41 Mr. Kemble Ave., Unit #203, Morristown, N.J. 07960-5118; David S. Kerr, 35 Gunther St., Mendham, N.J. 07945

[21] Appl. No.: 09/482,898

[22] Filed: Jan. 14, 2000

[51] Int. Cl.[7] ..... H01R 4/24

[52] U.S. Cl. ..... 439/395; 174/138 F

[58] Field of Search ..... 439/459, 395, 439/400, 521, 592; 174/138 F

[56] References Cited

U.S. PATENT DOCUMENTS 2,120,150 6/1938 Marshall ..... 174/138 F 2,670,870 3/1954 Fleischer ..... 174/138 F

*Primary Examiner*—Brian Sircus

*Assistant Examiner*—Phuong KT Dinh

*Attorney, Agent, or Firm*—Woodridge & Associates, P.C.; Richard C. Woodbridge

[57] ABSTRACT

An insulation displacement contact (IDC) strain relief cap is employed to interconnect a wire with an electrical contact. The electrical contact has a bifurcated end to engage and retain a wire and may be engaged with the strain relief cap. The cap contains notches, some of which fit on retaining cams that are attached to the electrical contact while others serve as wire exit holes. The cap fastens onto the clip once the retaining cams engage the notches and once the wire is aligned with the appropriate exit hole.

10 Claims, 3 Drawing Sheets

IDC TWIST CAP STRAIN RELIEF

BACKGROUND OF THE INVENTION

1. Field of the Invention

This invention relates to an electrical connector for insulation displacement contact (IDC) with insulation conducting wire. The invention finds particular utility in telecommunications where wires terminate in central office and building entrances.

2. Description of Prior Art

It is common to find the use of insulation displacement contact (IDC) technology in the electrical connector industry, because it allows rapid and simple connection of conducting wires to terminals without stripping nor crimping. A typical IDC connection is made by disposing an insulated conducting wire perpendicular to a planar wall portion comprising an IDC slot, stuffing a wire into the slot such that edges thereof cut through the insulation and make electrical contact with conducting strands of a wire. The IDC slots are generally formed by opposed edges of the sheet metal wall portion which is necessarily of a certain width to have sufficient strength to support the contact pressure against the edges.

Commercially available connectors that utilize insulation displacement contact (IDC) technology provide strain relief for multiple conductors. IDC pins are molded into the connector body which is used to support the strain relief member. These commercially available connectors are designed to terminate multiple conductors in a single connector. Strained relief for these types of connectors are designed as an intregal part of the connector body securing all conductors within a single strain relief member. Although this technology finds particular applicability when multiple wires are to be connected and unconnected, it does not lend itself to large pin array connectors where individual wires need to be reworked or rerouted without jeopardizing adjacent connections. Strain relief of the individual contacts or pins provide a great benefit during reworking or rerouting of individual wires.

SUMMARY OF THE INVENTION

It is a primary object of the present invention to provide strain relief for individual IDC pins or contacts.

It is another object of the invention to provide individual strain relief pins that make IDC a viable technology for large pin array connectors.

A further object of the invention is to provide strain relief for individual pins or contacts to allow for automated assembly of large pin arrays.

Yet a further object of the invention is to provide strain relief for individual IDC connections to ensure robust electrical connections, while allowing wiring changes and repairs without compromising adjacent electrical connections.

It is yet another object of the invention to provide strain relief for individual IDC pins or contacts to replace wire wrap technology on current products.

The foregoing objects have been accomplished by providing an IDC strain relief cap that operates in conjunction with a IDC contact to retain an insulated wire with the contact.

DETAILED DESCRIPTION OF THE INVENTION

Figure 1:
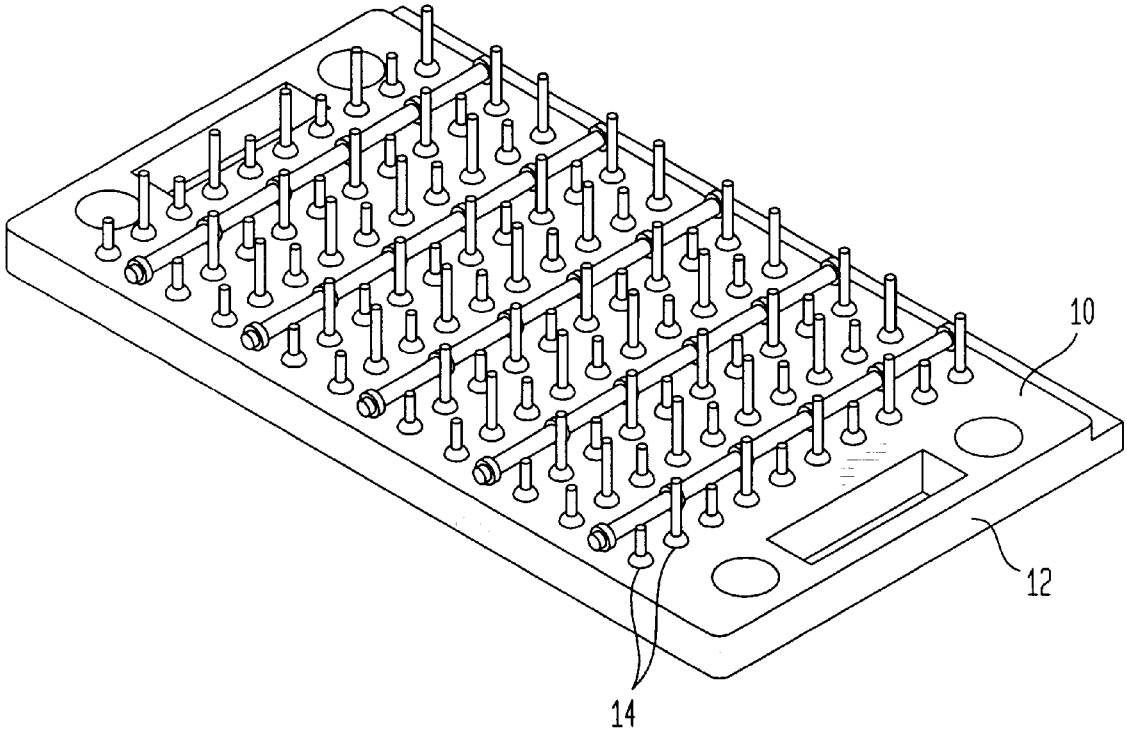
FIG. 1 is an isometric back view of a current projection block having wire wrap pins.
Figure 2:
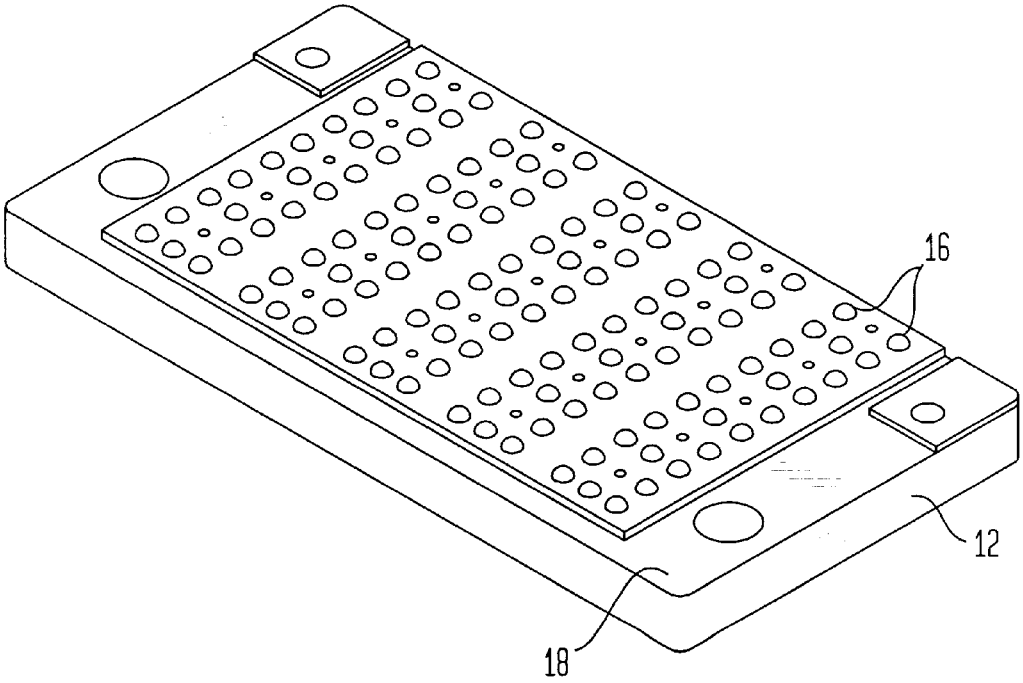
FIG. 2 is an isometric front view of a current projection block having wire wrap pins.

FIG. 1. Illustrates the back 10 of a relatively standard protection block 12 with wire wrap pins 14 projecting through cylindrical openings 16 (FIG. 2) on the front 18 of block 12. In the prior art, wire not shown, is wrapped in a spiral fashion around the pins 14 to provide contact. As described later in the specification, the disclosure of the present invention can make use of protection block 12.

Figure 3:
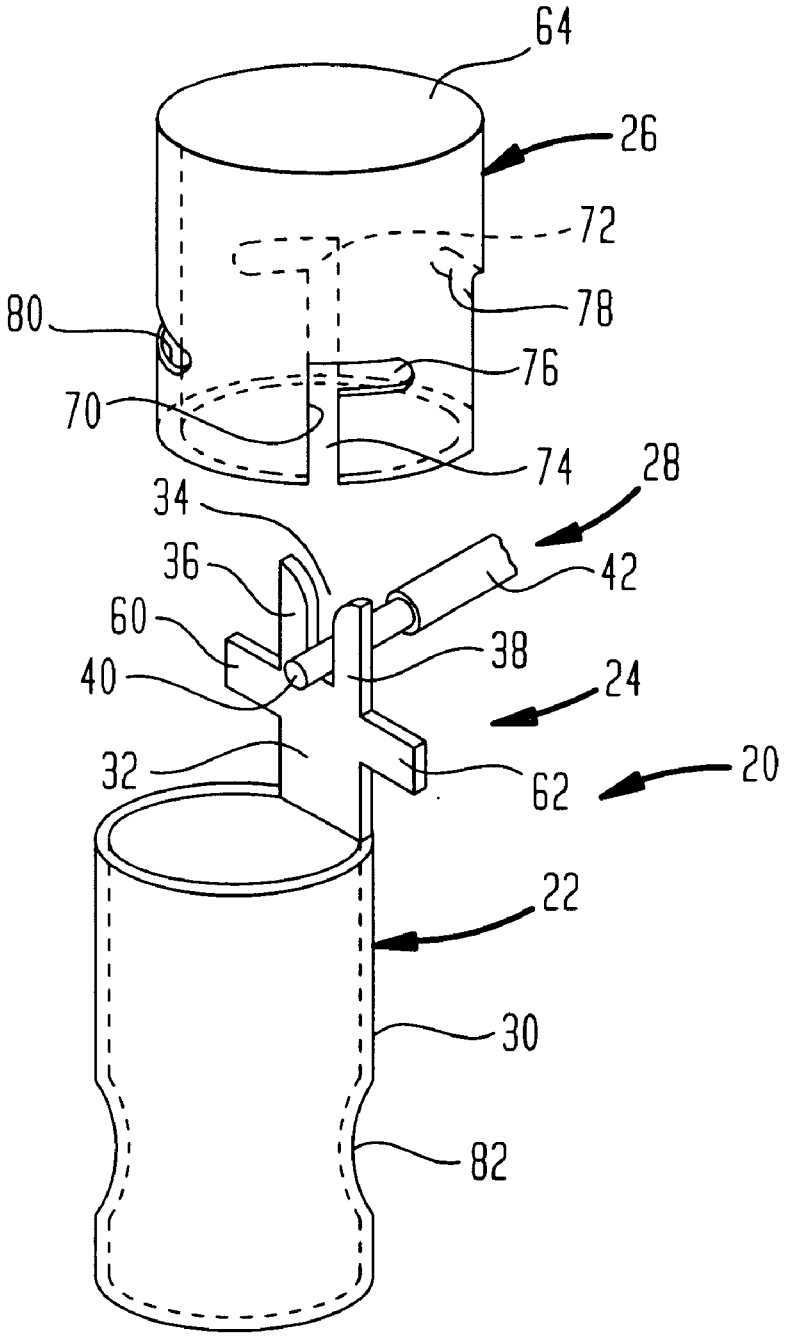
FIG. 3 is an exploded view of an IDC connection according to the disclosure.

FIG. 3 illustrates an IDC pin and strain relief cap assembly 20 having an IDC contact 22 terminating at one end in a retainer clip 24 that is engageable with a strain relief cap 26 to retain a wire 28. IDC contact 22 includes a cylindrical hollow body portion 30 having a significant length to engage and be retained by a pin 14 on protection block 12. Opposite from body portion 30 of IDC contact 22, retaining clip 24 includes a bifurcated end 32 having a slot 34 defined by a pair of arms 36 and 38 to grasp and retain wire 28. Wire 28 is of a type commonly used to transmit electricity or signals and includes a center portion 40 made, for example, of solid copper that is surrounded by appropriate insulation 42 to protect center portion 40 from the exterior environment.

Figure 4:
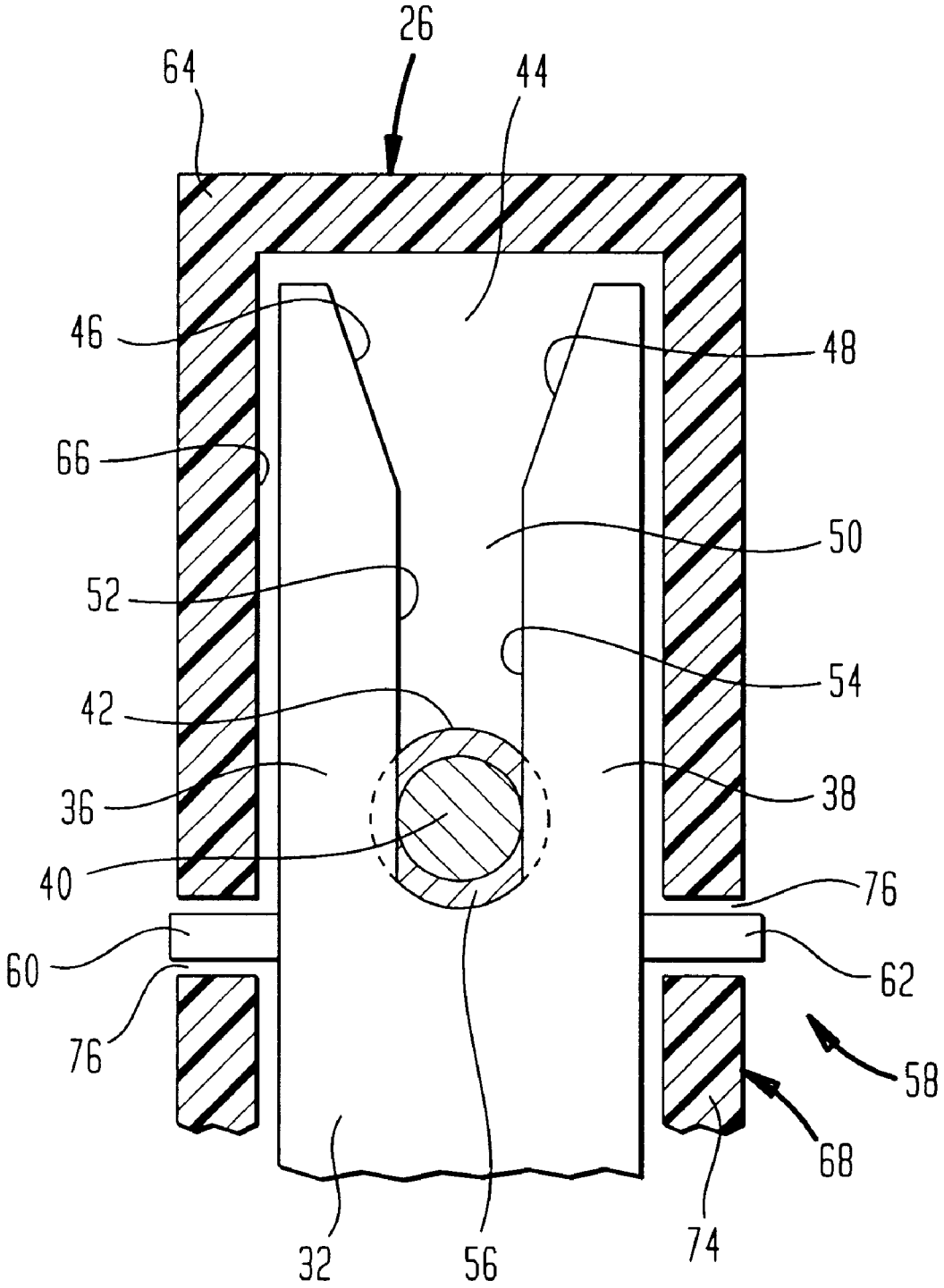
FIG. 4 is an enlarged sectional view of a portion of the IDC connection according to the disclosure.

As depicted in FIG. 4, slot 34 of bifurcated end 32 is defined by an entry section 44 having a pair of angled surfaces 46 and 48 terminating at an end portion 50 defined by parallel sides 52 and 54 and a curved end 56. Parallel sides 52 and 54 are spaced a distance apart that is slightly less than the diameter of center portion 40 of wire 28. Curved end 56 is of a shape to conform to a portion of the wire 28. In assembly the wire moves into bifurcated end 32 between arms 36 and 38, by angled surfaces 46 and 48 into end portion 50 whereby parallel sides 52 and 54 cut through the insulation 42 of wire 28 thereby making contact with center portion 40 of wire 28. The wire is moved in a direction until contact is made between wire 28 and end portion 56 of bifurcated end 32 of IDC contact 22.

IDC contact 22 is preferably made of a standard metal material such as a steel alloy coated with brass to transmit electrical signals or electricity to the pins 14. In the preferred embodiment, retaining means 58 comprises retaining cams 60 and 62 connected to arms 36 and 38 of bifurcated end 32, which cams are inflexible and extend outwardly at an angle as shown in FIGS. 3 and 4. These retaining means 58 will be discussed in greater detail in reference to assembly of strained relief cap 26 with IDC contact 22 of assembly 20.

Strain relief cap 26 includes a body portion 64 defining a cavity 66 to receive bifurcated end 32 of IDC contact 22. Body portion 64 includes gripping means 68 illustrated as a pair of locking windows 70 and 72 oppositely spaced on body portion 64 to receive and retain retaining cams 60 and 62 when bifurcated end 32 is located within cavity 66.

In a preferred embodiment, the retaining cams 60 and 62 are located diametrically opposed from one another. The locking window 70 and 72 are similarly located to correspond to the location of retaining cams 60 and 62. As best shown in FIG. 3, the locking windows may be of a shoe-shape or "L" configuration, each having a longitudinally extending entry slot 74 that terminates in a laterally or circumferentially extending slot 76 to retain retaining cams 60 and 62 as illustrated in FIG. 4. In its preferred embodiment, strain relief cap 26 is a cylindrical, cup-shaped member having axially extending entry slots opening into the open end of the cap. Wire slots 78 and 80 have been positioned diametrically opposed from one another to receive wire 28. It should be appreciated that only one wire slot 78 is needed, if it is chosen to terminate center portion 40 within cavity 66 of strain relief cap 26. Wire slots 78 and 80 may be configured similar to locking windows 70 and 72. Further, although it is illustrated that bifurcated end 32 extends upwardly from a side surface of contact 22, it may be bent in a know matter relative to the side surface toward the axis of cylindrical portion 30 and then upward in FIG. 3 along the axis to center the bifurcated end 32 relative to cylindrical portion 30. In this manner a cylindrical cap 26 can be positioned axially around a portion of cylindrical portion 30.

In assembly, IDC contact is engaged with a pin 14 extending outwardly from a block 12. The end of a wire 28 is located within bifurcated end 32 a distance to ensure contact of the wire across the entire length of groove 34 of bifurcated end 32. The wire is moved downwardly between angled surfaces 46 and 48 to a position in contact with parallel sides 52 and 54. Strain relief cap 26 is then located over bifurcated end 32, with bifurcated end 32 within cavity 66. The cap 26 is aligned with bifurcated end 32 to ensure that longitudinally extending entry slot 74 of locking windows 70 and 72, are respectively aligned with retaining cams 60 and 62. Additionally, the longitudinally extending entry slot 74 of wire slot 78, must be aligned with wire 28. The cap is then moved downwardly over bifurcated end 32 until contact is made with the top portion of retaining cams 60 and 62, with the upper portions of circumferentially extending slot 76 of locking windows 70 and 72. Wire slot is so configured that at this position, room is provided between the upper surface of circumferentially extending slot 76 of wire slot 78 with the insulation 42 of wire 28. If a second wire slot 80 is provided in retaining cap 26, this slot will be configured similar to wire slot 78, allowing for the wire to extend through the retaining cap. It should be appreciated that the wire slot 80 is not needed and that wire 26 may terminate within cavity 66 of retaining cap 26. Once contact is made between the upper surfaces of retaining cams 60 and 62 with the upper surfaces of circumferentially extending slots 76 of locking windows 70 and 72, the cap may then be twisted as shown in FIG. 3, in a clockwise direction to lock retaining cams 60 and 62 at the end portion of locking windows of 70 and 72 to thereby releasably retain cap 26 relative to contact 22.

As is known to those skilled in the art, retaining cams 60 and 62, along with circumferentially slot 76 of locking windows 70 and 72, may be so constructed as to ensure tight and relatively permanent engagement of cap 26 relative to contact 22.

It is possible to construct cap 26 in other configurations other than cylindrical. The significance of the configuration of the cap is to ensure the presence of the longitudinally extending entry slot 74 and circumferentially extending slot 76 to retain the retaining cams 60 and 62. It is also necessary to ensure that at least one other slot 78, having a similar configuration, is provided so that during assembly of cap 26, relative to contact 22, the retaining cams 60 and 62 and wire 28 may move in a general longitudinal direction along longitudinally extending entry slots 74 and then be free to move in a general lateral or circumferential direction along circumferentially extending slots 76 of locking windows 70 and 72 and wire slot 78, and 80 if provided. If, for example, cap 26 would be square or rectangular, retaining cams 60 and 62 would have to be long enough to continue engagement with body portion 64 of cap 26 during twisting movement of cap 26 relative to contact 22.

To disassemble cap 26 from contact 22, a reverse, or clockwise twisting action as shown in FIG. 3, will be employed until wire 28 and retaining cams 60 and 62 are aligned with the respective longitudinally extending entry slots 74 and then the cap may be moved longitudinally upward away from the contact, thereby exposing the wire within the bifurcated end 32.

It should be appreciated that the cap 26 is also so constructed to allow for automated assembly of assembly 20 with pins 14. To this end, it is desirable, to design the contacts 22 in cap 26 in a consistent manner to allow for first placement of the wire in the slots 34, and then rapid movement and twisting of the cap 26 relative to the contact 22. Insertion of the contact 22 into the respective pin may occur before or after securement of cap 26 to contact 22.

Further, end 30 of contact 22 is constructed in a known manner to be engaged with or disengaged from a pin 14 in a rapid manner when it is necessary to change contact points for the wires 28 relative to the pins 14 on block 12. Retention means in the form of an annular indentation 82 on end 30 can be used for this purpose.

What is claimed is:

1. An IDC strain relief cap assembly to interconnect a wire with an electrical contact, said assembly comprising:

a. an IDC contact having
   (i) a first end,
   (ii) means to engage and make electrical contact between said first end and said electrical contact, and
   (iii) a bifurcated end having spaced arms with inwardly facing opposed surfaces to make contact with sides of a wire located between said inwardly facing opposed surfaces;

b. an open-ended box shaped strain relief cap member having
   (i) surfaces defining a cavity to receive said bifurcated end,
   (ii) a pair of opposed longitudinally extending entry cam slots opening into said open end of said relief cap and each terminating at a mating laterally extending slot to define an "L" shaped opening, and
   (iii) a longitudinally extending entry wire slot opening into said open end of said relief cap and terminating at a mating laterally extending slot to define an "L" shaped opening, said wire slot being located between said cam, slots;

c. a cam on each arm of said bifurcated end extending outwardly a distance away from said arms toward and beyond said surfaces defining said cavity when said bifurcated end is located within said cavity whereby a wire may be located between said inwardly facing opposed surfaces and said relief cap may be placed over said bifurcated end with said wire in said longitudinally extending wire slot and said cams in said longitudinally extending cam slots and moved longitudinally toward said bifurcated end and then twisted laterally to move said lateral slots relative to said cams and said wire respectively and thereby releasably retain said relief cap relative to said IDC contact.

2. An assembly according to claim 1 wherein:

a. said contact is a cylindrically shaped pin; and b. said means to engage and make electrical contact with said pin is a cylindrical hollow member having an inner diameter slightly smaller than the diameter of said pin to encircle said pin for relatively rigid engagement.

3. An assembly according to claim 2 wherein:

a. said bifurcated end is centered relative to said cylindrical hollow member along the axis of said cylindrical hollow member; and b. said relief cap is a cylindrical cup-shaped member.

4. An assembly according to claim 1 wherein said open-ended box shaped strain relief cap has a second longitudinally extending wire slot opening into said open end of said relief cap and terminating at a mating laterally extending slot to define an "L" shaped opening, said wire slots being opposed from one another and each being located between a cam slot in the configuration of cam slot, wire slot, cam slot and wire slot whereby a wire may be located across said bifurcated end between said inwardly facing opposed surfaces and said relief cap may be placed over said bifurcated end with said wire in said longitudinally extending wire slots and said cams in said longitudinally extending cam slots and move longitudinally toward said bifurcated end and then twisted laterally to move said lateral slots relative to said cams and said wire respectively and thereby releasably retain said relief cap relative to said IDC contact.

5. The assembly of claim 1 wherein said relief cap is a generally cylindrical cup-shaped member.

6. An assembly to make electrical contact with a protective block having a cylindrical shaped pin, said assembly comprising a. a metal IDC contact having (i) a first end having a hollow cylindrically shaped portion to engage said pin on said protective block to retain said IDC contact relative to said block, (ii) a bifurcated end having spaced longitudinally extending arms with inwardly facing opposed surfaces spaced a distance to retain a wire located between said opposed surfaces, and (iii) a cam on each arm extending laterally away from each of said longitudinally extending arms;

b. an open ended box shaped strain relief cap encircling said bifurcated end and enclosing said bifurcated end on one end, said relief cap having;

(i) a pair of generally opposed cam slots extending along the circumference of said box shaped member and each engaged with one of said laterally extending cams, and (ii) a wire slot extending along the circumference of said box shaped member; and c. a wire located in said wire slot and between said inwardly facing opposed surfaces in contact with said spaced arms to transmit an electrical signal from said wire to said IDC contact.

7. An assembly according to claim 6 wherein each of said cam and wire slots terminate in a longitudinally extending slot opening into the open end of said box shaped strain relief cap to each form a generally "L" shaped slot with the mating circumferential slot with each of said generally "L" shaped slots being aligned in the same "L" shaped position relative to one another.

8. An assemble according to claim 6 wherein said strain relief cap is a generally cylindrical cup-shaped member.

9. An assembly according to claim 6 wherein:

a. said cam slots are diametrically opposed; and b. said wire slot is located equally between said cam slots.

10. An assembly according to claim 6 wherein:

a. there are two wire slots on opposite sides of said box shaped member; and b. said wire is located with each of said wire slots.

* * * * *